US008850821B2

(12) United States Patent
Khan et al.

(10) Patent No.: US 8,850,821 B2
(45) Date of Patent: Oct. 7, 2014

(54) SYSTEM FOR FUEL INJECTION IN A FUEL NOZZLE

(75) Inventors: Abdul Rafey Khan, Greenville, SC (US); Bradley Donald Crawley, Simpsonville, SC (US); Donald Mark Bailey, Simpsonville, SC (US); Ajay Pratap Singh, Bangalore (IN)

(73) Assignee: General Electric Company, Schenectady, NY (US)

( * ) Notice: Subject to any disclaimer, the term of this patent is extended or adjusted under 35 U.S.C. 154(b) by 488 days.

(21) Appl. No.: 13/269,510

(22) Filed: Oct. 7, 2011

(65) Prior Publication Data

US 2013/0086910 A1 Apr. 11, 2013

(51) Int. Cl.

| | |
|---|---|
| ***F02C 1/00*** | (2006.01) |
| ***F23R 3/28*** | (2006.01) |
| ***F23R 3/36*** | (2006.01) |
| ***F23R 3/14*** | (2006.01) |

(52) U.S. Cl.

CPC . *F23R 3/286* (2013.01); *F23R 3/36* (2013.01); *F23C 2900/07001* (2013.01); *F23R 3/14* (2013.01); *F23R 2900/00013* (2013.01); *F23D 2900/14021* (2013.01)

USPC ..... 60/740; 60/742; 60/737; 60/748

(58) Field of Classification Search

CPC ..... F23R 3/286; F23R 3/14

USPC ..... 60/737, 748, 742, 740

See application file for complete search history.

(56) References Cited

U.S. PATENT DOCUMENTS

| | | | | |
|---|---|---|---|---|
| 5,284,438 | A * | 2/1994 | McGill et al. | 431/9 |
| 5,551,228 | A | 9/1996 | Mick et al. | |
| 5,778,676 | A * | 7/1998 | Joshi et al. | 60/746 |
| 6,272,840 | B1 * | 8/2001 | Crocker et al. | 60/776 |
| 6,655,145 | B2 * | 12/2003 | Boardman | 60/737 |
| 6,691,515 | B2 | 2/2004 | Verdouw et al. | |
| 6,880,340 | B2 * | 4/2005 | Saitoh | 60/737 |
| 7,117,679 | B2 * | 10/2006 | Toon et al. | 60/740 |
| 7,640,725 | B2 * | 1/2010 | Bland et al. | 60/39.281 |
| 7,707,833 | B1 * | 5/2010 | Bland et al. | 60/737 |
| 7,836,698 | B2 | 11/2010 | Vandale et al. | |
| 7,966,820 | B2 | 6/2011 | Romoser | |
| 2005/0268618 | A1 | 12/2005 | Johnson et al. | |
| 2007/0157624 | A1 * | 7/2007 | Bland et al. | 60/776 |
| 2008/0083229 | A1 | 4/2008 | Haynes et al. | |
| 2010/0186413 | A1 | 7/2010 | Lacy et al. | |
| 2011/0000214 | A1 | 1/2011 | Helmick et al. | |

FOREIGN PATENT DOCUMENTS

EP 0762057 A1 3/1997

OTHER PUBLICATIONS

EP Search Report and Written Opinion dated Mar. 5, 2014 issued in connection with corresponding EP Application No. 12187320.2.

* cited by examiner

*Primary Examiner* — Gerald L Sung
(74) *Attorney, Agent, or Firm* — Fletcher Yoder, P.C.

(57) ABSTRACT

A system includes a fuel nozzle. The fuel nozzle includes a hub, a shroud disposed about the hub, an airflow path between the hub and the shroud, multiple first fuel outlets disposed on the hub, and multiple swirl vanes disposed in the airflow path downstream from the multiple first fuel outlets.

22 Claims, 5 Drawing Sheets

SYSTEM FOR FUEL INJECTION IN A FUEL NOZZLE

BACKGROUND OF THE INVENTION

The subject matter disclosed herein relates to a fuel nozzle with an improved fuel injection design.

A gas turbine engine combusts a mixture of fuel and air to generate hot combustion gases, which in turn drive one or more turbines. In particular, the hot combustion gases force turbine blades to rotate, thereby driving a shaft to rotate one or more loads, e.g., an electrical generator. The gas turbine engine includes a fuel nozzle to inject fuel and air into a combustor. As appreciated, the fuel air mixture significantly affects engine performance, fuel consumption, and emissions. In particular, non-uniform mixing of fuel and air may increase emissions, e.g., nitrogen oxides ($NO_x$). Also, in some fuel nozzles, fuel may be injected via fuel outlets located on vanes disposed within the fuel nozzle. However, limited space for fuel injection on the vanes may lead to poor flame holding margins and fuel distribution.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In accordance with a first embodiment, a system includes a fuel nozzle. The fuel nozzle includes a hub, a shroud disposed about the hub, an airflow path between the hub and the shroud, multiple first fuel outlets disposed on the hub, and multiple swirl vanes disposed in the airflow path downstream from the multiple first fuel outlets.

In accordance with a second embodiment, a system includes a fuel nozzle. The fuel nozzle includes a hub, a shroud disposed about the hub, an airflow path between the hub and the shroud, and a swirl mechanism disposed in the airflow path. The fuel nozzle also includes a first fuel path leading to multiple first fuel outlets directed into the airflow path upstream from the swirl mechanism. The fuel nozzle further includes a second fuel path leading to multiple second fuel outlets directed into the airflow path, wherein the multiple second fuel outlets is downstream from the multiple first fuel outlets, and the first and second fuel paths are configured to supply independently controlled amounts of fuel to the multiple first and second outlets, respectively.

In accordance with a third embodiment, a system includes a fuel nozzle. The fuel nozzle includes a hub, a shroud disposed about the hub, an airflow path between the hub and the shroud, a converging-diverging geometry disposed along the airflow path, multiple first fuel outlets directed into the airflow path along the converging diverging geometry, and multiple second fuel outlets directed into the airflow path at an axial offset distance from the converging-diverging geometry

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

Figure 1:
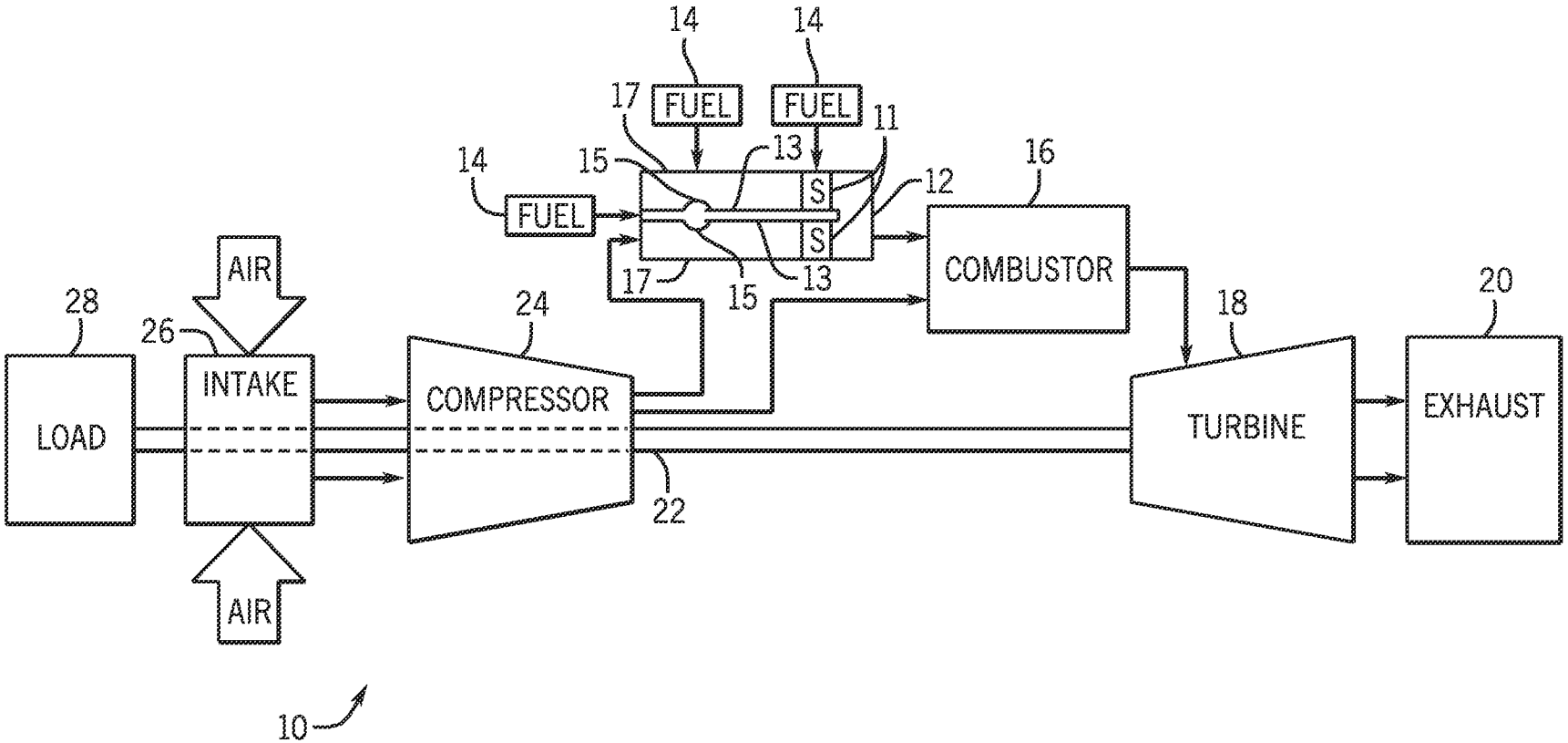
FIG. 1 is a block diagram of an embodiment of a turbine system having a fuel nozzle with an improved fuel injection design.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The present disclosure is directed to systems for improving the injection of fuel (e.g., liquid and/or gas) into a fuel nozzle, thereby enhancing fuel wobbe capability (i.e., interchangeability of fuels used), flame holding margin (e.g., reducing the possibility of flame holding), premixing of the fuel (e.g., premixing fuel and air), and control over the fuel-air profile. In particular, embodiments of the present disclosure include a distributed fuel injection circuit that enables injection of fuel (e.g., liquid and/or gas) via fuel outlets disposed on a hub or shroud upstream from fuel outlets located on vanes (e.g., swirl vanes) extending between the hub and the shroud. In certain embodiments, the fuel nozzle includes a common fuel passage that splits fuel flow between the fuel outlets upstream of the vanes and the fuel outlets on the vanes enabling passive control of fuel between the respective fuel outlets. In other embodiments, the fuel nozzle includes separate fuel passages that enable independent fuel flows to fuel outlets upstream of the vanes and the fuel outlets on the vanes enabling active control (e.g., via a controller) of fuel to the respective fuel outlets. The fuel outlets upstream of the vanes may be located on a converging-diverging geometry of the hub. In addition, the fuel outlets upstream of the vanes may be oriented at an angle (e.g., less than 90 degrees relative to an axis of the fuel nozzle) in a downstream direction and/or circumferentially about the axis of the fuel nozzle to induce swirl about the axis. Further, the fuel outlets upstream of the vanes may be spaced circumferentially about the hub and/or include sets of fuel outlets axially offset from one another relative to the axis of the fuel nozzle. By utilizing the distributed fuel injection circuit in the disclosed embodiments, fuel may be injected via the hub and/or shroud upstream of the vanes to enhance the fuel wobbe capability, flame holding margin, premixing of the fuel, and control over the fuel-air profile, while reducing emissions.

Turning now to the drawings and referring first to FIG. 1, a block diagram of an embodiment of a turbine system 10 is illustrated. As described in detail below, the disclosed turbine system 10 (e.g., a gas turbine engine) may employ one or more fuel nozzles 12 (e.g., turbine fuel nozzles) with an improved design for fuel injection to enhance the fuel wobbe capability, flame holding margin, premixing of the fuel, and control over the fuel-air profile, while reducing emissions (e.g., NOx) in the turbine system 10. For example, each fuel nozzle 12 may include a distributed fuel injection circuit configured to enhance the fuel wobbe capability, flame holding margin, premixing of fuel with air, and control over the fuel-air profile in the fuel nozzle 12. The turbine system 10 may use liquid and/or gas fuel, such as natural gas and/or a hydrogen rich synthetic gas, to drive the turbine system 10. As depicted, one or more fuel nozzles 12 intake a fuel supply 14 (e.g., liquid and/or gas fuel), mix the fuel with air, and distribute the air-fuel mixture into a combustor 16 in a suitable ratio for optimal combustion, emissions, fuel consumption, and power output. In particular, the distributed fuel injection circuit may provide fuel to fuel outlets disposed in a region of a swirl mechanism 11 (e.g., on swirl vanes) and fuel outlets upstream from the swirl mechanism 11. For example, the fuel outlets upstream from the swirl mechanism 11 may be disposed on a hub 13 (e.g., on a converging-diverging geometry 15) and/or a shroud 17 of the fuel nozzle 12. The turbine system 10 may include one or more fuel nozzles 12 located inside one or more combustors 16. The air-fuel mixture combusts in a chamber within the combustor 16, thereby creating hot pressurized exhaust gases. The combustor 16 directs the exhaust gases through a turbine 18 toward an exhaust outlet 20. As the exhaust gases pass through the turbine 18, the gases force turbine blades to rotate a shaft 22 along an axis of the turbine system 10. As illustrated, the shaft 22 may be connected to various components of the turbine system 10, including a compressor 24. The compressor 24 also includes blades coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. The load 28 may include any suitable device capable of being powered by the rotational output of the turbine system 10.

Figure 2:
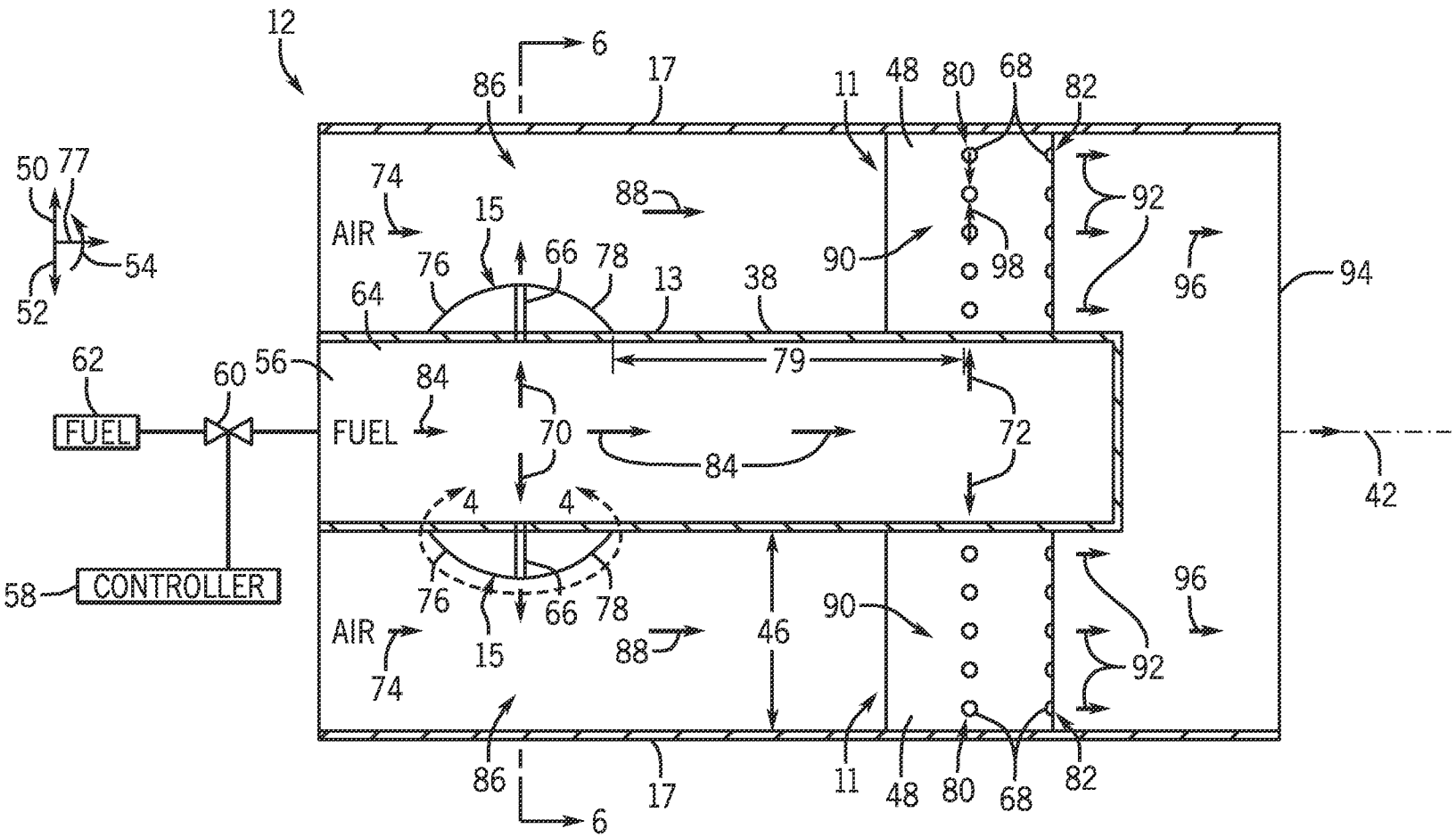
FIG. 2 is a cross-sectional side view of an embodiment of the fuel nozzle, as illustrated in FIG. 1, with the fuel nozzle having an improved fuel injection design (e.g., passive control)

FIG. 2 is a cross-sectional side view of an embodiment of the fuel nozzle 12, as illustrated in FIG. 1, with the fuel nozzle 12 having an improved fuel injection design to enhance the fuel wobbe capability, flame holding margin, premixing of the fuel, and control over the fuel-air profile, while reducing emissions. The fuel nozzle 12 (e.g., turbine fuel nozzle) is configured to mount in the combustor 16 (e.g., turbine combustor) of the gas turbine engine 10. The fuel nozzle 12 includes a center body 38 (e.g., annular inner body), the swirl mechanism 11, and the shroud 17 (e.g., annular outer body), each disposed about an axis 42. The center body 38 includes the hub 13 (e.g., an annular wall) disposed inside and concentric with the shroud 17, wherein the shroud 17 and the hub 13 are offset from one another by a radial gap 46. The swirl mechanism 11 includes a plurality of vanes 48 (e.g., swirl vanes). The vanes 48 extend radially in directions 50 and 52 between the shroud 17 and the hub 13, and are distributed circumferentially 54 about the axis 42. The shroud 17 is circumferentially 54 disposed about the hub 13 and the plurality of vanes 48, with the vanes 48 extending between the hub 13 and shroud 17. The fuel nozzle 12 may include any number of vanes 48. The fuel nozzle 12 may include 1 to 20 or 2 to 10 vanes 48, or any number therebetween. The center body 38 also includes fuel passage 56. A controller 58 controls the flow of fuel via a valve 60 from a fuel supply 62 to the fuel nozzle 12 (e.g., fuel passage 56).

The fuel passage 56 includes a common fuel passage 64 that extends through the inner body 38 and leads to a plurality of first fuel outlets 66 disposed on the hub 13 and a plurality of second fuel outlets 68 disposed in the region of the swirl mechanism 11 (e.g., on the plurality of vanes 48). As illustrated, the plurality of first fuel outlets 66 is disposed upstream from the plurality of second fuel outlets 68. The common fuel passage 64 splits a fuel flow between the first fuel outlets 66 and the second fuel outlets 68 as indicated by arrows 70 and 72. Approximately 30 percent or less of the total fuel in the common fuel passage 64 may be diverted to the first fuel outlets 66. For example, approximately 5, 10, 15, 20, 25, or 30 percent, or any other number therebetween of the total fuel in the common fuel passage 64 may be diverted to the first fuel outlets 66. The common fuel passage 64 enables passive control over the injection of fuel via the fuel outlets 66 and 68. The first fuel outlets 66 are disposed on the hub 13 upstream from the swirl mechanism 11 (e.g., vanes 48). In particular, the first fuel outlets 66 are disposed on the converging-diverging geometry 15 of the hub 13 along an airflow path 74. The converging-diverging geometry 15 includes a converging portion 76 that gradually converges toward the shroud 17 in an axial direction 77 and a diverging portion 78 that gradually diverges away from the shroud 17 in the axial direction 77. The diverging portion 78 is disposed downstream of the converging portion 76 in the axial direction 77. In certain embodiments, the first fuel outlets 66 may be disposed on another portion of the hub 13 (e.g., besides the converging-diverging geometry 15) upstream of the swirl mechanism 11. The plurality of second fuel outlets 68 is disposed at an axially offset distance 79 downstream from the converging diverging geometry 15. The first fuel outlets 66 are oriented outward in the radial directions 50 and 52 (i.e. crosswise) relative to the axis 42 of the fuel nozzle 12. In some embodiments, the first fuel outlets 66 may also be distributed on the shroud 17 (see FIG. 3) upstream of the swirl mechanism 11. The illustrated fuel outlets 66 may each represent one or more fuel outlets 66 disposed circumferentially 54 about the hub 13 (see FIGS. 6 and 7).

As mentioned above, the plurality of second fuel outlets 68 is disposed in the region of the swirl mechanism 11 (e.g., on the plurality of vanes 48). Each vane 48 includes one or more fuel outlets 68. In addition, each vane 48 may include a first set 80 of fuel outlets 68 and a second set 82 of fuel outlets 68 axially offset from each other along the axis 42 of the fuel nozzle 12 in the axial (i.e., downstream) direction 77. The number of fuel outlets 68 on each vane 48 may range from 1 to 50, 1 to 10, 4 to 20, or 4 to 10, or any other number. For example, each vane 48 may include one or more fuel outlets 68 (e.g., 1 to 10) on each side. The plurality of vanes 48 is configured to swirl or rotate the air flow, while mixing fuel with air.

Fuel flows into the common fuel passage 64 as indicated by arrows 84. The common fuel passage 64 splits the fuel flow into a first fuel flow 70 to the plurality of first fuel outlets 66 and a second fuel flow 72 to the plurality of second fuel outlets 68. For example, fuel (e.g., gas fuel) flows in the axial direction 77 through the fuel passage 64 until a portion of the fuel exits the first fuel outlets 66 in radial directions 50 and 52 into a first mixing region 86. In particular, the fuel exits the fuel outlets 66 disposed on the hub 13 crosswise to the axis 42 of the fuel nozzle 12. As illustrated, the fuel nozzle 12 include the airflow path (e.g., annular flow path), generally indicated by arrow 74, between the hub 13 and the shroud 17. Air flows in the axial direction 77 into the first mixing region 86. In the first mixing region 86, the fuel from the fuel outlets 66 interacts with the air. The fuel-air mixture 88 flows downstream towards the swirl mechanism 11 (e.g., blades 48) disposed in the airflow path 74. Another portion of the fuel exits the second fuel outlets 68 into a second mixing region 90. The fuel-air mixture 88 flows through the airflow path 74 into the second mixing region 90 surrounding each vane 48. In the mixing region 90 of each vane 48, fuel from the fuel outlets 68 interacts with the fuel-air mixture 88 to form a fuel-air mixture 92. The fuel-air mixture 92 is swirled by the vanes 48 to aid in mixing of the fuel and air for proper combustion, and flows downstream towards an exit 94 of the fuel nozzle 12, as generally indicated by arrows 96.

The injection of fuel upstream of the swirl mechanism 11 enhances the flame holding margins (e.g., reducing the possibility of flame holding) around the vanes 48. In particular, diverting a portion of the fuel for upstream injection enables a reduction in a diameter 98 of the fuel outlets 68 on the vanes 48 enhancing the flame holding margin. For example, the reduction in diameter 98 of the fuel outlet 68 relative to a typical fuel outlet 68 may range from approximately 1 to 99 percent, 10 to 90 percent, 20 to 80 percent, 30 to 70 percent, or 40 to 60 percent, and all subranges therebetween. The reduction in diameter 98 of the fuel outlet 68 may be approximately 5, 10, 15, 20, 25, 30, 35, 40, 45, 50, 55, 60, 65, 70, 75, 80, 85, 90, or 95 percent, or any other number.

In addition to reducing the possibility of flame holding, the improved fuel injection design enhances premixing efficiencies which reduces emissions. In addition, the improved fuel injection design provides fuel injection from both a circumferential direction 54 and radial direction 50 and 52 to provide better control over the overall fuel-air profile of the fuel nozzle 12 and, thus, improve the dynamics and operability of the fuel nozzle 12. Further, the improved fuel injection design enhances wobbe capability and fuel flexibility for the fuel nozzle 12.

Figure 3:
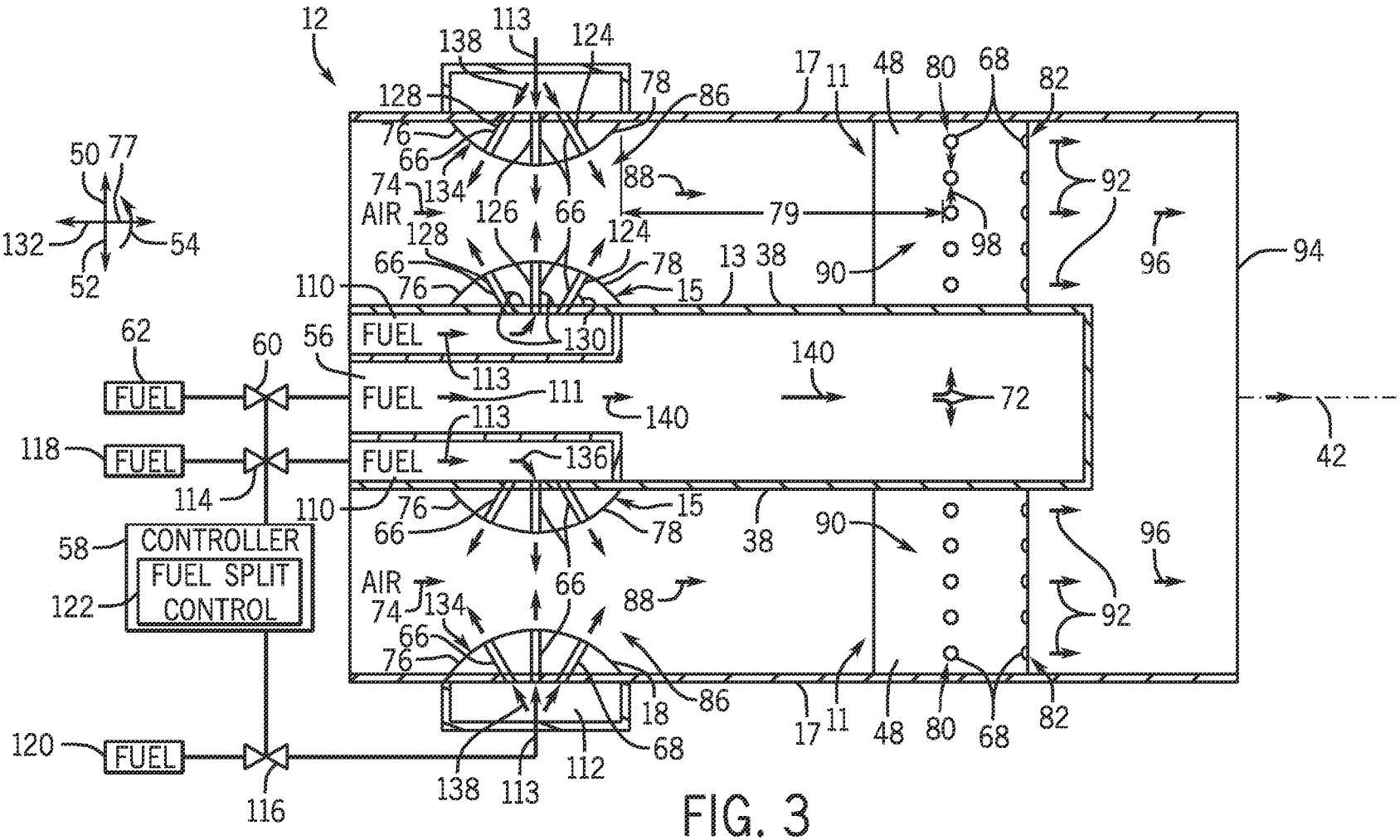
FIG. 3 is a cross-sectional side view of an embodiment of the fuel nozzle, as illustrated in FIG. 1, with the fuel nozzle having an improved fuel injection design (e.g., active control)

As mentioned above, fuel may be injected from fuel outlets 66 located at other locations besides and/or in addition to the hub 13 upstream of the swirl mechanism 11. In addition, the fuel passages to the different fuel outlets 66 and 68 may be separate, enabling active control over the fuel flows. FIG. 3 is a cross-sectional side view of an embodiment of the fuel nozzle 12, as illustrated in FIG. 1, with the fuel nozzle 12 having an improved fuel injection design to enhance the fuel wobbe capability, flame holding margin, premixing of the fuel, and control over the fuel-air profile, while reducing emissions. The fuel nozzle 12 of FIG. 3 is as described in FIG. 2, except the fuel nozzle 12 includes fuel outlets 66 disposed on the shroud 17 upstream of the swirl mechanism 11 and separate fuel passages for the fuel outlets 66 and 68. The center body 38 of the fuel nozzle 12 includes fuel passage 56, fuel passages 110, and fuel passages 112. The fuel passage 56 provides a fuel flow (e.g., fuel path 111) to the fuel outlets 68 disposed on the vanes 48. The fuel passages 110 and 112 provide fuel flows (e.g., fuel paths 113) to the fuel outlets 66 disposed on the hub 13 and shroud 17, respectively. The fuel paths 111 and 113 are configured to supply independently controlled amounts of fuel to the fuel outlets 68 and 66, respectively. A controller 58 controls the flow of fuel via valves 60, 114, and 116 from respective fuel supplies 62, 118, and 120 to the respective fuel passages 56, 110, and 112. The fuel (e.g., gas and/or liquid fuel) from the fuel supplies 62, 118, and 120 may be the same or different. The controller 58 includes a fuel split control 122 configured to control the fuel flows to the outlets 66 and 68 independent from one another. The different fuel passages 56, 110, and 112 in conjunction with the controller 58 enables active control of fuel injection via the fuel outlets 66 and 68 and, thus, the ability to change fuel pressure and fuel pressure dynamics. For example, the fuel split control 122 may actively adjust the split of the fuel (e.g., ratio of fuel flows into the fuel passages 56, 110, and 112 or percent of fuel to each set of fuel outlets 66 and 68).

As mentioned above, the plurality of first fuel outlets 66 are disposed on the hub 13 (e.g., along the converging-diverging geometry 15). Each illustrated fuel outlet 66 may represent one or more fuel outlets 66 circumferentially 54 disposed about the axis 42 of the fuel nozzle 12 (see FIGS. 6 and 7). The plurality of first fuel outlets 66 includes a first set 124 of first fuel outlets 66, a second set 126 of first fuel outlets 66, and a third set 128 of first fuel outlets 66. The first, second, and third sets 124, 126, and 128 of fuel outlets 66 are axially offset from one another relative to the axis 42 of the first fuel nozzle 12. As illustrated, each fuel outlet 66 is directed into the airflow path 74. In particular, each fuel outlet 66 is oriented at an angle 130 relative to the axis 42 of the fuel nozzle 12. The fuel outlets 66 may be oriented at the angle 130 in an upstream (e.g., axial) direction 132 (e.g., third set 128 of the fuel outlets 66) or the downstream (e.g., axial) direction 77 (e.g., first set 124 of the fuel outlets 66) along the airflow path 74. In addition, the fuel outlets 66 may be oriented directly perpendicular (e.g., crosswise) to the airflow path 74 (e.g., second set 126 of the fuel outlets 66). The angle 130 of each fuel outlet 66 relative to the axis 42 of the fuel nozzle 12 may range from approximately 0 to 180 degrees, 0 to 90 degrees, 90 to 180 degrees, 0 to 45 degrees, 45 to 90 degrees, 90 to 135 degrees, or 135 to 180 degrees, and all subranges therebetween. For example, the angle 130 may be approximately 10, 20, 30, 40, 50, 60, 70, 80, 90, 100, 110, 120, 130, 140, 150, 160, 170, or 180 degrees, or any other angle. In certain embodiments, each fuel outlet 66 is oriented at the angle 130 in the downstream direction 77 along the airflow path 74, where the angle 130 is less than approximately 90 degrees relative to the axis 42 of the fuel nozzle 12 (see FIG. 5). In some embodiments, each fuel outlet 66 of the plurality of first outlets 66 is oriented at an angle circumferentially about the axis 42 of the fuel nozzle 12 to induce an injected fuel to swirl about the axis 42, where the angle is less than 90 degrees relative to the axis 42 (see FIG. 7).

As illustrated, the fuel nozzle 12 also includes the plurality of first outlets 66 disposed on the shroud 17. The first outlets 66 are located along a converging-diverging geometry 134. The converging-diverging geometry 134 is similar to the converging-diverging geometry 15. In certain embodiments, the first outlets 66 may be disposed upstream of the swirl mechanism 11 (e.g., vanes 48) on a portion of the shroud 17 different from the converging-diverging geometry 134. The first outlets 66 disposed on the shroud 17 are similar to the first outlets 66 disposed on the hub 13. The plurality of first outlets 66 on the shroud 17 (and converging-diverging geometry 134) may be disposed directly across from the plurality of first outlets 66 on the hub 13 (and converging-diverging geometry 15). In certain embodiments, the plurality of first outlets 66 on the shroud 17 may be axially offset from the plurality of fuel outlets 66 on the hub 13 along the axis 42 of the fuel nozzle 12.

Fuel flows into the fuel path 113 leading to the plurality of first fuel outlets 66 directed into the airflow path 74 upstream from the swirl mechanism 11. In particular, fuel flows into fuel passages 110 and 112 as indicated by arrows 136 and 138, respectively. For example, fuel (e.g., liquid and/or gas fuel) flows in the axial direction 54 through the fuel passages 110 and exits the first fuel outlets 66 in the radial directions 50 and 52 into the first mixing region 86. Also, fuel (e.g., liquid and/or gas fuel) flows through the fuel passages 112 and exits the first fuel outlets 66 in the radial directions 50 and 52 into the first mixing region. In particular, the fuel exits the fuel outlets 66 disposed on the hub 13 and shroud 17 crosswise to the axis 42 of the fuel nozzle 12. For example, the fuel outlets 66 disposed on the hub 13 and shroud 17 are oriented crosswise to one another (e.g., in outward 50 and inward 52 radial directions, respectively) and to axis 42. As illustrated, the fuel nozzle 12 include the airflow path (e.g., annular flow path), generally indicated by arrow 74, between the hub 13 and the shroud 17. Air flows in the axial direction 54 into the first mixing region 86. In the first mixing region 86 the fuel from the fuel outlets 66 interacts with the air. The fuel-air mixture 88 flows downstream towards the swirl mechanism 11 (e.g., blades 48) disposed in the airflow path 74.

As mentioned above, the plurality of second fuel outlets 68 is disposed in a region of the swirl mechanism 11 (e.g., on the swirl vanes 48). Fuel flows into the fuel path 111 leading to the plurality of second fuel outlets 68 directed into the airflow path 74. In particular, fuel flows into fuel passage 56 as indicated by arrows 140, and flows to the fuel outlets 68 on the vanes 48 as indicated by arrows 72. Fuel exits the second fuel outlets 68 into the second mixing region 90. The fuel-air mixture 88 flows through the airflow path 74 into the second mixing region 90 surrounding each vane 48. In the mixing region 90 of each vane 48, fuel from the fuel outlets 68 interacts with the fuel-air mixture 88 to form a fuel-air mixture 90. The fuel-air mixture 90 is swirled by the vanes 48 to aid in mixing of the fuel and air for proper combustion, and flows downstream towards the exit 94 of the fuel nozzle 12, as generally indicated by arrows 96.

The injection of fuel upstream of the swirl mechanism 11 enhances the flame holding margins around the vanes 48. In particular, diverting a portion of the fuel for upstream injections enables a reduction in a diameter 98 of the fuel outlets 68 on the vanes 48 enhancing the flame holding margin. For example, the reduction in diameter 98 of the fuel outlet 68 relative to a typical fuel outlet 68 may range from approximately 1 to 99 percent, 10 to 90 percent, 20 to 80 percent, 30 to 70 percent, or 40 to 60 percent, and all subranges therebetween. The reduction in diameter 98 of the fuel outlet 68 may be approximately 5, 10, 15, 20, 25, 30, 35, 40, 45, 50, 55, 60, 65, 70, 75, 80, 85, 90, or 95 percent, or any other number.

In addition to reducing the possibility of flame holding, the improved fuel injection design improves premixing efficiencies which reduces emissions. In addition, the improved fuel injection design provides fuel injection from both a circumferential direction 54 and radial direction 50 and 52 to provide better control over the overall fuel-air profile of the fuel nozzle 12 and, thus, improves the dynamics and operability of the fuel nozzle 12. In particular, the improved fuel injection design enables a staged mixing of fuel with air. Further, the improved fuel injection design enhances wobbe capability and fuel flexibility for the fuel nozzle 12. In particular, the multiple fuel passages 56, 111, and 113 enable different fuels (e.g., liquid and/or gas fuels) to be employed with the fuel nozzle 12.

Figure 4:
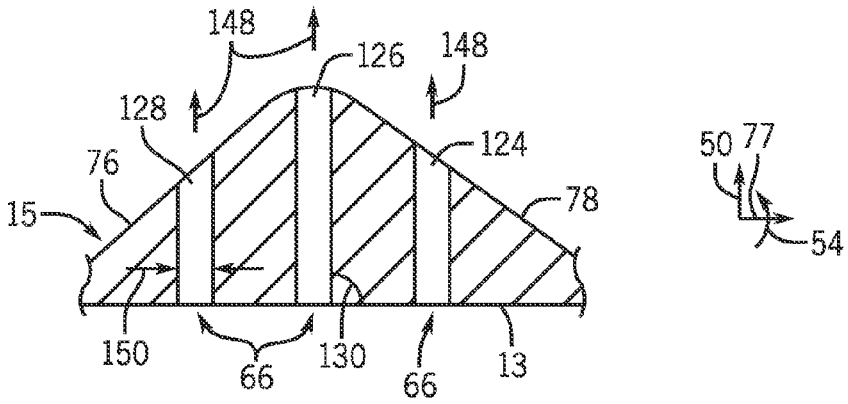
FIG. 4 is a partial cross-sectional side view of an embodiment of the fuel nozzle of FIG. 2 taken within line 4-4, illustrating multiple fuel outlets.

FIGS. 4-7 illustrate various embodiments of the arrangement of the fuel outlets 66 upstream of the swirl mechanism 11. The arrangement of the fuel outlets 66 upstream of the swirl mechanism 11 enhances the fuel wobbe capability, flame holding margin, premixing of the fuel, and control over the fuel-air profile, while reducing emissions (e.g., NOx) in the turbine system 10. FIG. 4 is a partial cross-sectional side view of an embodiment of the fuel nozzle 12 of FIG. 2, taken within line 4-4, illustrating multiple fuel outlets 66. As illustrated, the converging-diverging geometry 15 of the hub 13 includes the plurality of first fuel outlets 66. The converging-diverging geometry 15 is as described in FIG. 2. Each illustrated fuel outlet 66 may represent one or more fuel outlets 66 circumferentially 54 disposed about the axis 42 of the fuel nozzle 12 (see FIGS. 6 and 7). The plurality of first fuel outlets 66 includes the first set 124 of first fuel outlets 66, the second set 126 of first fuel outlets 66, and the third set 128 of first fuel outlets 66. The first, second, and third sets 124, 126, and 128 of fuel outlets 66 are axially offset from one another relative to the axis 42 of the first fuel nozzle 12.

As illustrated, each fuel outlet 66 is directed into the airflow path 74. In particular, each fuel outlet 66 is oriented at the angle 130 relative to the axis 42 of the fuel nozzle 12. Specifically, the illustrated fuel outlets 66 are oriented directly perpendicular (e.g., crosswise) in radial direction 50 to the airflow path 74 with each fuel outlet 66 including the angle 130 of 90 degrees relative to the axis 42 of the fuel nozzle 12. Thus, fuel exits the fuel outlets in radial direction 50 crosswise to the airflow path 74 as indicated by arrows 148. Alternatively, the fuel outlets 66 may be oriented at the angle 130 in an upstream (e.g., axial) direction 132 (e.g., third set 128 of the fuel outlets 66) or the downstream (e.g., axial) direction 77 (e.g., first set 124 of the fuel outlets 66) along the airflow path 74 (see FIG. 3). As mentioned above, the angle 130 of each fuel outlet 66 relative to the axis 42 of the fuel nozzle 12 may range from approximately 0 to 180 degrees, 0 to 90 degrees, 90 to 180 degrees, 0 to 45 degrees, 45 to 90 degrees, 90 to 135 degrees, or 135 to 180 degrees, and all subranges therebetween. For example, the angle 130 may be approximately 10, 20, 30, 40, 50, 60, 70, 80, 90, 100, 110, 120, 130, 140, 150, 160, 170, or 180 degrees, or any other angle.

In addition, each fuel outlet 66 may include a diameter 150. The diameter 150 of each fuel outlet 66 may range from approximately 0.5 to 1.8 mm, 0.75 to 1.55 mm, 1 to 1.3 mm, 0.5 to 1.0 mm, 1 to 1.8 mm, 1.3 to 1.8 mm, and all subranges therebetween. For example, the diameter 150 each fuel outlet 66 may be approximately 0.5, 0.6, 0.7, 0.8, 0.9, 1.0, 1.1, 1.2, 1.3, 1.4, 1.5, 1.6, 1.7, or 1.8 mm, or any other number therebetween. The diameter 150 of each fuel outlet 66 may be the same or different at different axial positions. The difference in diameter 150 between fuel outlets 66 may vary by approximately 10 to 200 percent relative to one another. For example, the diameter 150 of the fuel outlets 66 may vary by approximately 10 to 100 percent, 10 to 50 percent, 50 to 100 percent, 100 to 200 percent, 100 to 150 percent, 150 to 200 percent, and all subranges therebetween. For example, the diameter 150 between fuel outlets 66 may vary by approximately 10, 20, 30, 40, 50, 60, 70, 80, 90, 100, 110, 120, 130, 140, 150, 160, 170, 180, 190, or 200 percent, or any other number therebetween.

Figure 5:
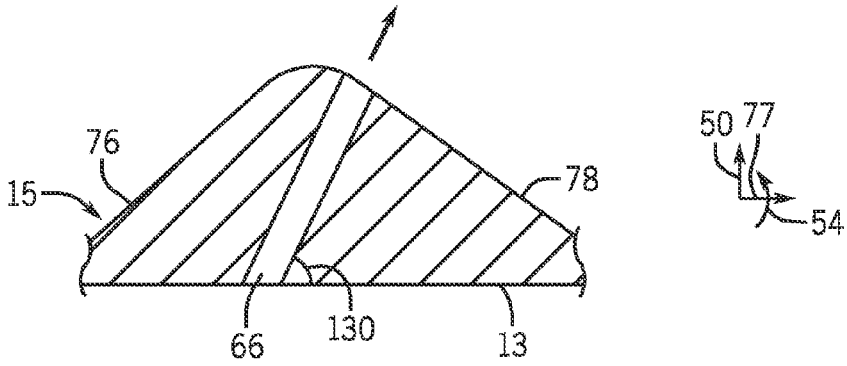
FIG. 5 is a partial cross-sectional side view of an embodiment of the fuel nozzle of FIG. 2 taken within line 4-4, illustrating an angled fuel outlet.

FIG. 5 is a partial cross-sectional side view of an embodiment of the fuel nozzle 12 of FIG. 2 taken within line 4-4 that illustrates an angled fuel outlet 66. As illustrated, the converging-diverging geometry 15 of the hub 13 includes the plurality of first fuel outlets 66. The converging-diverging geometry 15 is as described in FIG. 2. Each illustrated fuel outlet 66 may represent one or more fuel outlets 66 circumferentially 54 disposed about the axis 42 of the fuel nozzle 12 (see FIGS. 6 and 7). As illustrated, the fuel outlets 66 are directed into the airflow path 74. In particular, each fuel outlet 66 is oriented at the angle 130 in the downstream direction 77 along the airflow path 74, where the angle 130 is less than approximately 90 degrees relative to the axis 42 of the fuel nozzle 12. Angling the fuel injection downstream enables premixing of the fuel and air without impeding the flow through the airflow path 74.

Figure 6:
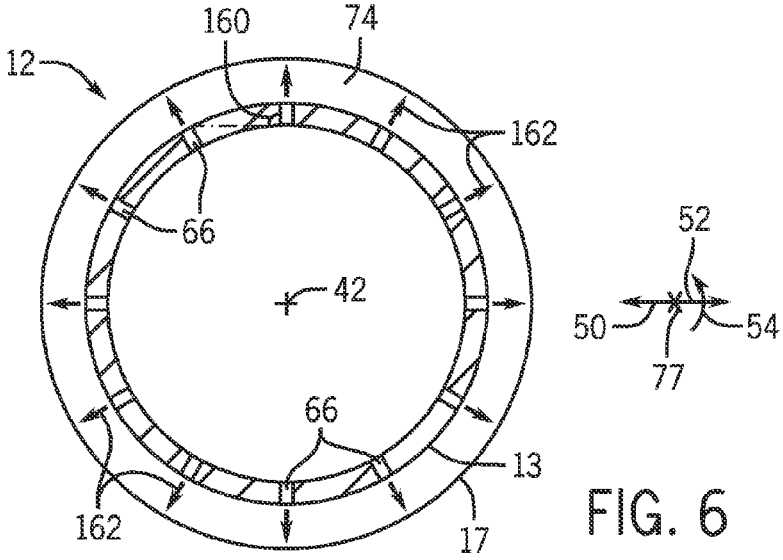
FIG. 6 is a cross-sectional view of an embodiment of the fuel nozzle of FIG. 2 taken along line-6-6, illustrating multiple fuel outlets.

FIG. 6 is a cross-sectional view of an embodiment of the fuel nozzle 12 of FIG. 2 taken along line 6-6 that illustrates multiple fuel outlets 66. The fuel nozzle 12 includes the hub 13, the shroud 17, and the plurality of the first fuel outlets 66 disposed about the axis 42. As illustrated, the fuel outlets 66 are circumferentially 54 disposed about the axis 42 of the fuel nozzle 12. In particular, fuel outlet 66 disposed on the hub 13 is directed into the airflow path 74 and oriented crosswise to the axis 42. Each fuel outlet 66 is oriented at an angle 160 circumferentially about the axis 42 (e.g., relative to a tangent line (illustrated dashed line)). The angle 160 of each fuel outlet 66 circumferentially about the axis 42 of the fuel nozzle 12 may range from approximately 0 to 180 degrees, 0 to 90 degrees, 90 to 180 degrees, 0 to 45 degrees, 45 to 90 degrees, 90 to 135 degrees, or 135 to 180 degrees, and all subranges therebetween. For example, the angle 160 may be approximately 10, 20, 30, 40, 50, 60, 70, 80, 90, 100, 110, 120, 130, 140, 150, 160, 170, or 180 degrees, or any other angle. As illustrated, each fuel outlet 66 includes the angle 160 of approximately 90 degrees. Each fuel outlet 66 is configured to inject fuel radially 50 and 52 into the airflow path 74 as indicated by arrows 162 to mix fuel with air flowing in axial direction 77.

Figure 7:
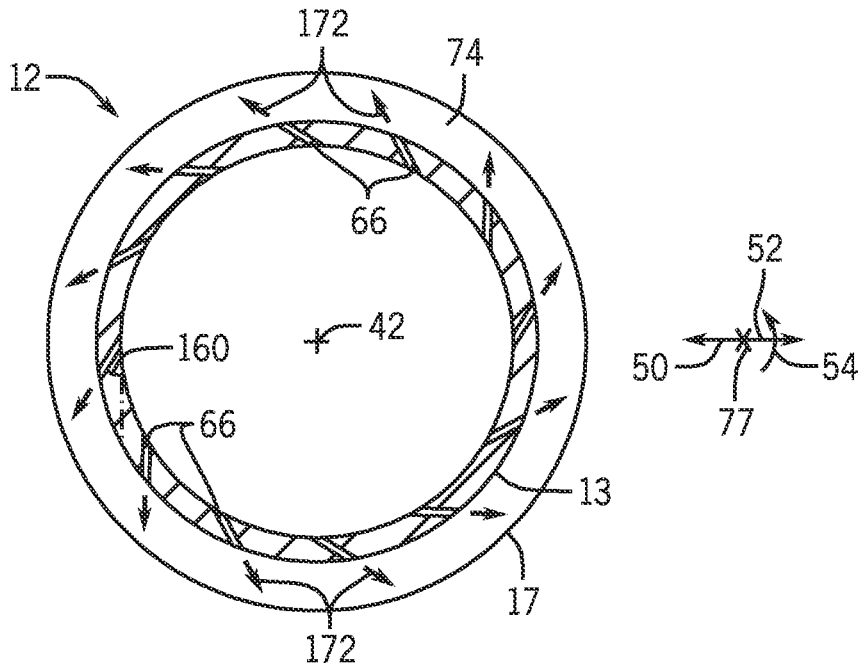
FIG. 7 is a cross-sectional view of an embodiment of the fuel nozzle of FIG. 2 taken along line 6-6, illustrating multiple angled fuel outlets for swirl-inducing fuel injection.

FIG. 7 is a cross-sectional view of an embodiment of the fuel nozzle 12 of FIG. 2 taken along line 6-6 that illustrates multiple angled fuel outlets 66 for swirl-inducing fuel injection. The fuel nozzle 12 is as described in FIG. 6 except the fuel outlets 66 are angled to induce swirl. In particular, each fuel outlet 66 is oriented at the angle 160 circumferentially about the axis 42 of the fuel nozzle 12 (e.g., relative to a tangent line (illustrated dashed line)). As illustrated, the angle 160 is less than approximately 90 degrees relative to the axis 42. The angle 160 may range from approximately 20 to 70 degrees, 30 to 60 degrees, 40 to 50 degrees, and all subranges therebetween. For example, the angle 160 may be approximately 10, 15, 20, 25, 30, 40, 45, 50, 55, 60, 65, 70, 75, 80, or 85 degrees, or any other angle. The angled fuel outlets 66 are configured to induce injected fuel to swirl circumferentially 54 about the axis as indicated by arrows 172. The induction of swirl may increase the premixing efficiency between the fuel and air.

Figure 8:
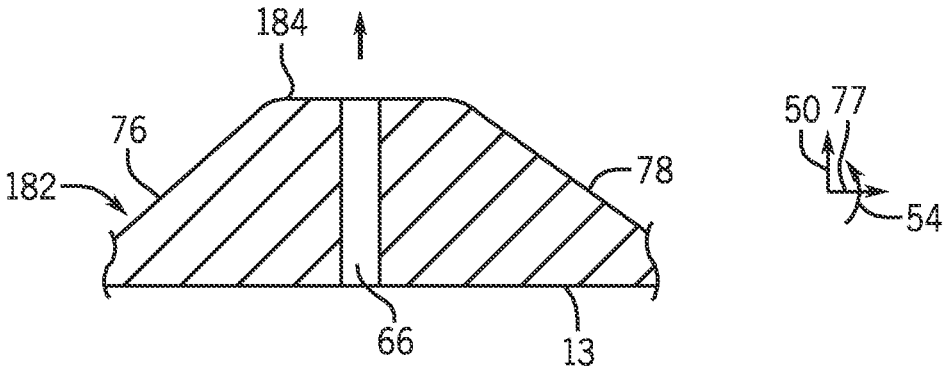
FIG. 8 is a partial cross-sectional view of an embodiment of the fuel nozzle of FIG. 2 taken within line 4-4, illustrating a converging-straight-diverging geometry with a fuel outlet.

Besides the converging-diverging geometry 15 mentioned above, one or more fuel outlets 66 may be disposed on different geometries of the hub 13 upstream of the swirl mechanism 11. FIG. 8 is a partial cross-sectional view of an embodiment of the fuel nozzle 12 of FIG. 2 taken within line 4-4 that illustrates a converging-straight-diverging geometry 182 with the fuel outlet 66. The converging-straight-diverging geometry 182 includes the converging portion 76 that gradually converges toward the hub 13 in the axial direction 77, a straight portion 184 that remains constant relative to the hub 13, and the diverging portion 78 that gradually diverges away from the hub 13 in the axial direction 77. The diverging portion 78 is disposed downstream of the converging portion 76 and the straight portion 184 in the axial direction 77. The straight portion 184 is disposed downstream of the converging portion 76 in the axial direction 77. The fuel outlet 66 may represent one or more fuel outlets 66 disposed circumferentially about the hub 13. In certain embodiments, the geometry 184 may include multiple sets of fuel outlets 66 axially offset from one another relative to the axis 42 of the fuel nozzle 12. The fuel outlets 66 may be disposed on the converging portion 76, straight portion 184, and/or diverging portion 78. In certain embodiments, the fuel outlets 66 may be angled as described above. The geometries 15 and 184 of the hub 13 with the fuel outlets 66 are only examples of various geometries. In certain embodiments, the arrangement and shape of the geometry of the hub 13 with the fuel outlets 66 may vary from the geometries 15 and 184.

Technical effects of the disclosed embodiments include providing systems for improving injection of fuel into the fuel nozzle 12. Fuel outlets 66 located upstream from fuel injection in the region of the swirl mechanism 11 (e.g., vanes 48) enable hub 13 and shroud 17 injection of fuel crosswise to the airflow. The fuel may be distributed between these fuel outlets 66 for cross-flow injection at a variety of angles (e.g., 0 to 90 degrees). The improved design enhances the fuel wobbe capability, flame holding margin, premixing of the fuel, and control over the fuel-air profile, while reducing emissions (e.g., NOx) in the turbine system 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a fuel nozzle, comprising:

a hub;

a shroud disposed about the hub;

an airflow path between the hub and the shroud;

a plurality of first fuel outlets disposed on and extending through the hub;

a first converging-diverging geometry disposed along the hub, and the plurality of first fuel outlets are disposed along and extend through the first converging-diverging geometry; and a plurality of swirl vanes disposed in the airflow path downstream from the plurality of first fuel outlets.

2. The system of claim 1, wherein the fuel nozzle is a turbine fuel nozzle configured to mount in a turbine combustor of a gas turbine engine.

3. The system of claim 2, comprising the turbine combustor or the gas turbine engine having the turbine fuel nozzle.

4. The system of claim 1, wherein the fuel nozzle comprises a plurality of second fuel outlets disposed on the plurality of swirl vanes.

5. The system of claim 4, wherein the fuel nozzle comprises a common fuel passage disposed within the hub that splits a fuel flow into a first fuel flow to the plurality of first fuel outlets and a second fuel flow to the plurality of second fuel outlets.

6. The system of claim 4, wherein the fuel nozzle comprises a first fuel passage disposed within the hub to provide a first fuel flow to the plurality of first fuel outlets, a second fuel passage disposed within the hub to provide a second fuel flow to the plurality of second fuel outlets, and a controller configured to control the first and second fuel flows independent from one another.

7. The system of claim 1, wherein each fuel outlet of the plurality of first fuel outlets is oriented in a radially outward direction from an axis of the fuel nozzle.

8. The system of claim 1, wherein each fuel outlet of the plurality of first fuel outlets is oriented at an angle in a downstream direction along the airflow passage, and the angle is less than approximately 90 degrees relative to an axis of the fuel nozzle.

9. The system of claim 1, wherein each fuel outlet of the plurality of first fuel outlets is oriented at an angle circumferentially about an axis of the fuel nozzle to induce an injected fuel to swirl about the axis, and the angle is less than approximately 90 degrees relative to the axis.

10. The system of claim 1, wherein the plurality of first fuel outlets are spaced circumferentially about the hub.

11. The system of claim 1, wherein the plurality of first fuel outlets comprise a first set of first fuel outlets and a second set of first fuel outlets disposed on extending through the hub upstream from the plurality of swirl vanes, and the first and second sets of first fuel outlets are axially offset from one another relative to an axis of the fuel nozzle.

12. The system of claim 1, comprising a plurality of second fuel outlets disposed on and extending through the shroud upstream from the plurality of swirl vanes.

13. The system of claim 12, comprising a second converging-diverging geometry disposed along the shroud, and the plurality of second fuel outlets is disposed along and extends through the second converging-diverging geometry.

14. The system of claim 5, wherein the common fuel passage splits approximately 30 percent or less of the fuel flow into the plurality of first fuel outlets.

15. A system, comprising:

a fuel nozzle, comprising:

a hub;

a shroud disposed about the hub;

an airflow path between the hub and the shroud;

a swirl mechanism disposed in the airflow path;

a first fuel path leading to a plurality of first fuel outlets directed into the airflow path upstream from the swirl mechanism;

a second fuel path leading to a plurality of second fuel outlets directed into the airflow path, wherein the plurality of second fuel outlets is downstream from the plurality of first fuel outlets, the first and second fuel paths are configured to supply independently controlled amounts of fuel to the plurality of first and second fuel outlets, respectively, and the plurality of first fuel outlets is disposed on and extends through a converging-diverging geometry disposed along the airflow path.

16. The system of claim 15, wherein the fuel nozzle comprises a third fuel path leading to a plurality of third fuel outlets directed in the airflow path upstream of the swirl mechanism, the plurality of third fuel outlets is disposed on and extends through the shroud, the plurality of first fuel outlets is disposed on and extends through the hub, and the plurality of second fuel outlets is disposed in a region of the swirl mechanism.

17. The system of claim 15, wherein the system comprises a turbine combustor having the fuel nozzle, or the system comprises a gas turbine engine having the fuel nozzle, or the fuel nozzle is a turbine fuel nozzle.

18. The system of claim 15, wherein the first and second fuel paths are disposed within the hub.

19. A system, comprising:

a fuel nozzle, comprising:

a hub;

a shroud disposed about the hub;

an airflow path between the hub and the shroud;

a converging-diverging geometry disposed along the airflow path;

a plurality of first fuel outlets directed into the airflow path disposed along and extending through the converging-diverging geometry; the plurality of first fuel outlets disposed on and extending through the hub and a plurality of second fuel outlets directed into the airflow path at an axial offset distance from the converging-diverging geometry.

20. The system of claim 19, wherein the fuel nozzle comprises a swirl mechanism disposed along the airflow path downstream from the converging-diverging geometry.

21. The system of claim 20, wherein the plurality of second fuel outlets is disposed in a region of the swirl mechanism, and the swirl mechanism comprises a plurality of swirl vanes.

22. The system of claim 19, wherein the plurality of first fuel outlets comprise a first set of first fuel outlets and a second set of first fuel outlets disposed on and extending through the converging-diverging geometry, and the first and second sets of first fuel outlets are axially offset from one another relative to an axis of the fuel nozzle.

* * * * *